US010180148B2

(12) United States Patent
Coppedge et al.

(10) Patent No.: US 10,180,148 B2
(45) **Date of Patent: *Jan. 15, 2019**

(54) GAS GENERATOR DRIVEN HYDRAULIC ACCUMULATOR

(71) Applicant: BASTION TECHNOLOGIES, INC., Houston, TX (US)

(72) Inventors: Charles Don Coppedge, Houston, TX (US); Dewey James Louvier, Houston, TX (US); Anna Azzolari Ronalds, Houston, TX (US); Hildebrand A Rumann, League City, TX (US)

(73) Assignee: Bastion Technologies, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/976,094

(22) Filed: May 10, 2018

(65) Prior Publication Data

US 2018/0258961 A1 Sep. 13, 2018

Related U.S. Application Data

(63) Continuation of application No. 15/633,718, filed on Jun. 26, 2017, now Pat. No. 9,970,462, which is a (Continued)

(51) Int. Cl.
*F15B 1/24* (2006.01)
*E21B 41/00* (2006.01)
(Continued)

(52) U.S. Cl.
CPC ..... *F15B 1/24* (2013.01); *C06D 5/00* (2013.01); *E21B 33/0355* (2013.01);
(Continued)

(58) Field of Classification Search
CPC .. E21B 33/0355; E21B 33/064; E21B 33/038; E21B 41/00; E21B 41/0007;
(Continued)

(56) References Cited

U.S. PATENT DOCUMENTS 2,979,094 A 4/1961 Royer
3,018,627 A 1/1962 Perricci
(Continued)

FOREIGN PATENT DOCUMENTS

DE 102007001645 A1 7/2008
EP 0009346 A1 4/1980

OTHER PUBLICATIONS

International Search Report and Written Opinion for PCT/US201327680 dated May 8, 2013.
(Continued)

*Primary Examiner* — Matthew R Buck
*Assistant Examiner* — Patrick F Lambe
(74) *Attorney, Agent, or Firm* — Winstead PC

(57) ABSTRACT

An exemplary gas generator driven hydraulic accumulator includes an elongated body having a first end, a second end, and a bore extending axially from a barrier to the second end; a piston slidably disposed in the bore; in use a gas generator located in a chamber between the first end and the barrier; an orifice through the barrier providing fluid communication between the chamber and the bore; in use a hydraulic fluid disposed in the bore between the piston and the second end whereby the hydraulic fluid is exhausted under pressure through a discharge port in response to activation of the gas generator; and in use a one-way flow control device connected in a flow path of the discharge port to permit one-way flow of the hydraulic fluid from the bore and to block return fluid from through the discharge port into the bore.

20 Claims, 8 Drawing Sheets

Related U.S. Application Data continuation of application No. 14/969,672, filed on Dec. 15, 2015, now Pat. No. 9,689,406, which is a continuation of application No. 13/776,268, filed on Feb. 25, 2013, now Pat. No. 9,212,103.

(60) Provisional application No. 61/602,176, filed on Feb. 23, 2012.

(51) Int. Cl.

| | |
|---|---|
| ***E21B 33/035*** | (2006.01) |
| ***F15B 15/19*** | (2006.01) |
| ***E21B 34/04*** | (2006.01) |
| ***C06D 5/00*** | (2006.01) |
| ***F15B 1/08*** | (2006.01) |

(52) U.S. Cl.

CPC ..... *E21B 34/04* (2013.01); *E21B 41/00* (2013.01); *E21B 41/0007* (2013.01); *F15B 1/08* (2013.01); *F15B 15/19* (2013.01); *F15B 2201/20* (2013.01); *F15B 2201/205* (2013.01); *F15B 2201/411* (2013.01)

(58) Field of Classification Search

CPC .... B63C 11/52; F15B 1/24; F15B 1/08; F15B 15/09; F15B 2201/20; F15B 2201/205; F15B 2201/411; C06D 5/00

USPC ..... 166/363, 373, 63, 335; 102/531

See application file for complete search history.

(56) References Cited

U.S. PATENT DOCUMENTS

| | | | |
|---|---|---|---|
| 3,031,845 | A | 5/1962 | Ludwig |
| 3,077,077 | A | 2/1963 | Jones |
| 3,100,058 | A | 8/1963 | Peet |
| 3,100,965 | A | 8/1963 | Blackburn |
| 3,886,745 | A | 6/1975 | Kaida et al. |
| 3,933,338 | A | 1/1976 | Herd |
| 4,074,527 | A | 2/1978 | Sadler |
| 4,163,477 | A | 8/1979 | Johnson et al. |
| 4,308,721 | A | 1/1982 | Thomas et al. |
| 4,412,419 | A | 11/1983 | Thomas et al. |
| 4,461,322 | A | 7/1984 | Mills |
| 4,619,111 | A | 10/1986 | Whiteman |
| 4,777,800 | A | 10/1988 | Hay, II |
| 4,815,295 | A | 3/1989 | Narum |
| 5,004,154 | A | 4/1991 | Yoshida et al. |
| 5,072,896 | A | 12/1991 | McIntyre et al. |
| 5,316,087 | A | 5/1994 | Manke et al. |
| 5,481,977 | A | 1/1996 | Evans et al. |
| 5,647,734 | A | 7/1997 | Milleron |
| 6,202,753 | B1 | 3/2001 | Baugh |
| 6,418,970 | B1 | 7/2002 | Deul |
| 6,817,298 | B1 | 11/2004 | Zharkov et al. |
| 7,011,722 | B2 | 3/2006 | Amtower, II |
| 7,231,934 | B2 | 6/2007 | Biester |
| 7,721,652 | B2 | 5/2010 | Yoshida et al. |
| 7,810,569 | B2 | 10/2010 | Hill et al. |
| 8,453,575 | B2 | 6/2013 | Humbert et al. |
| 8,616,128 | B2 | 12/2013 | Sampson |
| 2009/0178433 | A1 | 7/2009 | Kumakura et al. |
| 2009/0211239 | A1 | 8/2009 | Askeland |
| 2010/0206389 | A1 | 8/2010 | Kennedy et al. |
| 2011/0108285 | A1 | 5/2011 | Fagley, IV et al. |
| 2011/0284237 | A1 | 11/2011 | Baugh |
| 2012/0048566 | A1 | 3/2012 | Coppedge et al. |
| 2012/0111572 | A1 | 5/2012 | Cargo, Jr. |

OTHER PUBLICATIONS

Extended European Search Report in EP Appl. No. 13751969.0, National Phase of PCT/US201327669 dated Oct. 22, 2015.

GAS GENERATOR DRIVEN HYDRAULIC ACCUMULATOR

BACKGROUND

This section provides background information to facilitate a better understanding of the various aspects of the disclosure. It should be understood that the statements in this section of this document are to be read in this light, and not as admissions of prior art.

Pre-charged hydraulic accumulators are utilized in many different industrial applications to provide a source of hydraulic pressure and operating fluid to actuate devices such as valves. It is common for installed hydraulic accumulators to be connected to or connectable to a source of hydraulic pressure to recharge the hydraulic accumulator due to leakage and/or use.

SUMMARY

An exemplary gas generator driven hydraulic accumulator includes an elongated body having a first end, a second end, and a bore extending axially from a barrier to the second end; a piston slidably disposed in the bore; in use a gas generator located in a chamber between the first end and the barrier; an orifice through the barrier providing fluid communication between the chamber and the bore; in use a hydraulic fluid disposed in the bore between the piston and the second end whereby the hydraulic fluid is exhausted under pressure through a discharge port in response to activation of the gas generator; and in use a one-way flow control device connected in a flow path of the discharge port to permit one-way flow of the hydraulic fluid from the bore and to block return fluid from through the discharge port into the bore.

An exemplary subsea well system includes an operational device located subsea and connected with a wellbore penetrating a seafloor, the operational device responsive to an operating pressure; a plurality of hydraulic accumulators located subsea, the plurality of hydraulic accumulators including a gas generator driven hydraulic accumulator having an elongated body having a first end, a second end, and a bore extending axially from a barrier to the second end; a discharge port in communication with the operational device; a piston slidably disposed in the bore; a propellant located in a chamber between the first end and the barrier; an orifice through the barrier providing fluid communication between the chamber and the bore; and a hydraulic fluid disposed in the bore between the piston and the second end at a pressure below the operating pressure, wherein the hydraulic fluid is exhausted through the discharge port and to the operational device at a pressure equal to or greater than the operating pressure in response to activation of the propellant.

An exemplary method includes supplying hydraulic fluid from two or more gas generator driven hydraulic accumulators at a pressure equal to or greater than an operating pressure to a hydraulically operated device that is located subsea and connected with a wellbore penetrating a seafloor, wherein the gas generator driven hydraulic accumulators include an elongated body having a first end, a second end, and a bore extending axially from a barrier to the second end; a discharge port in communication with the hydraulically operated device; a piston slidably disposed in the bore; a propellant located in a chamber between the first end and the barrier; an orifice through the barrier providing fluid communication between the chamber and the bore; a hydraulic fluid disposed in the bore between the piston and the second end at a pressure below the operating pressure. Igniting the propellant and pressurizing the hydraulic fluid in a first one of the two or more gas generator driven hydraulic accumulators to a pressure equal to or greater than the operating pressure and discharging the pressurized hydraulic fluid from the first one of the two or more gas generator driven hydraulic accumulators to the hydraulically operated device. Igniting the propellant and pressurizing the hydraulic fluid in a second one of the two or more gas generator driven hydraulic accumulators to a pressure equal to or greater than the operating pressure and discharging the pressurized hydraulic fluid from the second one of the two or more gas generator driven hydraulic accumulators to the hydraulically operated device.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion. As will be understood by those skilled in the art with the benefit of this disclosure, elements and arrangements of the various figures can be used together and in configurations not specifically illustrated without departing from the scope of this disclosure. For example, a figure may illustrate an exemplary embodiment with multiple features or combinations of features that are not required in one or more other embodiments and thus a figure may disclose one or more embodiments that have fewer features or a different combination of features than the illustrated embodiment.

DETAILED DESCRIPTION

Figure 1:
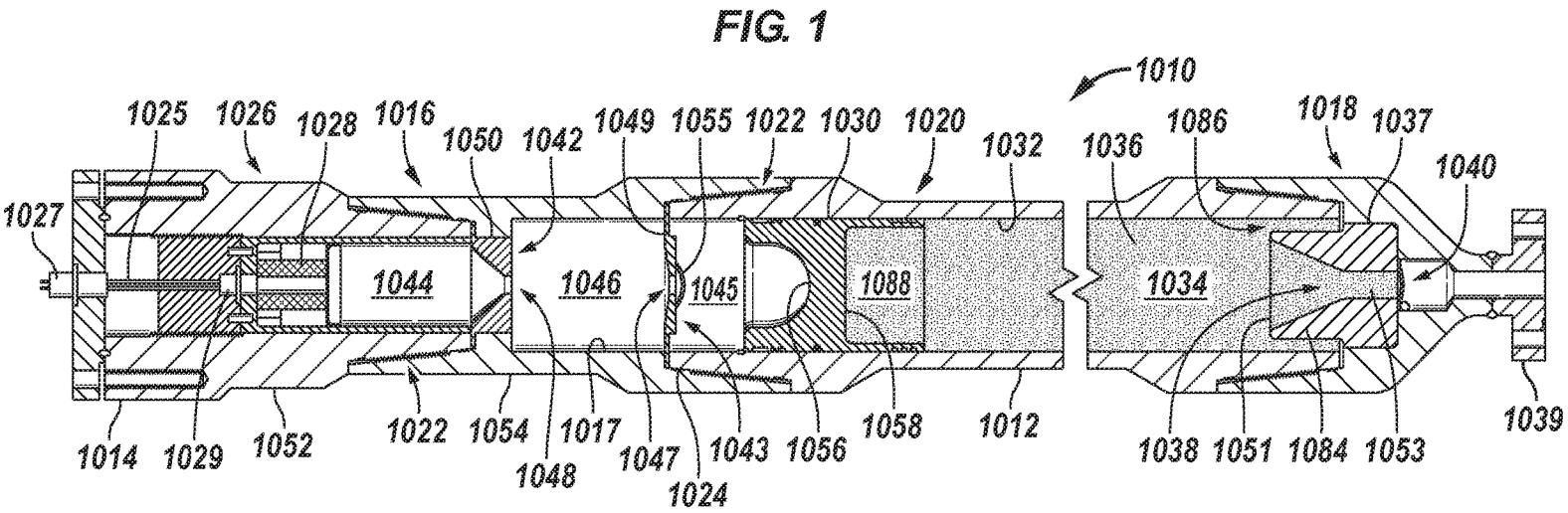
FIG. 1 is a schematic view of an exemplary gas generator driven hydraulic accumulator according to one or more aspects of the disclosure.

It is to be understood that the following disclosure provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrative embodiment. Therefore, combinations of features disclosed in the following detailed description may not be necessary to practice the teachings in the broadest sense, and are instead merely to describe particularly representative examples. In addition, the disclosure may repeat reference numerals and/or letters in the various examples. This repetition is for the purpose of simplicity and clarity and does not in itself dictate a relationship between the various embodiments and/or configurations discussed.

A gas generator driven hydraulic accumulator is disclosed that provides a useable storage of hydraulic fluid that can be pressurized to the operating pressure of a consumer for use on-demand. The gas generator driven hydraulic accumulator, also referred to herein as a gas generator driven or pyrotechnic accumulator, supplies pressurized hydraulic fluid to drive and operate devices and systems. The gas generator driven accumulator may be used in conjunction with or in place of pre-charged hydraulic accumulators. Example of utilization of the gas generator driven hydraulic accumulator are described with reference to subsea well systems, in particular safety systems; however, use of the gas generator driven hydraulic accumulator is not limited to subsea systems and environments. For example, and without limitation, gas generator driven hydraulic accumulator can be utilized to operate valves, bollards, pipe rams, and pipe shears. According to embodiments disclosed herein, the pressure supply device can be located subsea and remain in place without requiring hydraulic pressure recharging. In addition, when located for example subsea the gas generator driven hydraulic accumulator does not require charging by high-pressure hydraulic systems located at the surface.

FIG. 1 is a sectional view of an example of a gas generator driven hydraulic accumulator, generally denoted by the numeral 1010, according to one or more embodiments. As will be understood by those skilled in the art with the benefit of this disclosure, gas generator driven hydraulic accumulator 1010, also referred to as a pyrotechnic accumulator, may be utilized in many different applications to provide hydraulic fluid at a desired operating or working pressure to a connected operational device.

In the example of FIG. 1, gas generator driven hydraulic accumulator 1010 comprises an elongated body 1012 extending substantially from a first end 1014 of pyrotechnic section 1016 to a discharge end 1018 of a hydraulic section 1020. As will be understood by those skilled in the art with the benefit of this disclosure, body 1012 may be constructed of one or more sections (e.g., tubular sections). In the depicted embodiment, pyrotechnic section 1016 and hydraulic section 1020 are connected at a threaded joint 1022 (e.g., double threaded) having a seal 1024. In the depicted embodiment, threaded joint 1022 provides a high-pressure seal (e.g., hydraulic seal and/or gas seal).

A pressure generator 1026 (i.e., gas generator), comprising a pyrotechnic (e.g., propellant) charge 1028, is connected at first end 1014 and disposed in the gas chamber 1017 (i.e., expansion chamber) of pyrotechnic section 1016. In the depicted embodiment, gas generator 1026 comprises an initiator (e.g., igniter) 1029 connected to pyrotechnic charge 1028 and extending via electrical conductor 1025 to an electrical connector 1027. In this example, electrical connector 1027 is a wet-mate connector for connecting to an electrical source for example in a sub-sea, high-pressure environment.

A piston 1030 is moveably disposed within a bore 1032 of the hydraulic section 1020 of body 1012. A hydraulic fluid chamber 1034 is formed between piston 1030 and discharge end 1018. Hydraulic chamber 1034 is filled with a fluid 1036, e.g., non-compressible fluid, e.g., oil, water, or gas. Fluid 1036 is generally described herein as a liquid or hydraulic fluid, however, it is understood that a gas can be utilized for some embodiments. Hydraulic chamber 1034 can be filled with fluid 1036 for example through a port. Fluid 1036 is stored in hydraulic chamber 1034 at a pressure less than the operating pressure of the hydraulically operated consumers.

A discharge port 1038 is in communication with discharge end 1018 to communicate the pressurized fluid 1036 to a connected operational device (e.g., valve, rams, bollards, etc.). In the depicted embodiment, discharge port 1038 is formed by a member 1037, referred to herein as cap 1037, connected at discharge end 1018 for example by a bolted flange connection. A flow control device 1040 is located in the fluid flow path of discharge port 1038. In this example, flow control device 1040 is a one-way valve (i.e., check valve) permitting fluid 1036 to be discharged from fluid hydraulic chamber 1034 and blocking backflow of fluid into hydraulic chamber 1034. A connector 1039 (e.g., flange) is depicted at discharge end 1018 to connect hydraulic chamber 1034 to an operational device for example through an accumulator manifold. According to embodiments, gas generator driven hydraulic accumulator 1010 is adapted to be connected to a subsea system for example by a remote operated vehicle.

Upon ignition of pyrotechnic charge 1028, high-pressure gas expands in gas chamber 1017 and urges piston 1030 toward discharge end 1018 thereby pressurizing fluid 1036 and exhausting the pressurized fluid 1036 through discharge end 1018 and flow control device 1040 to operate the connected operational device.

Figure 2:
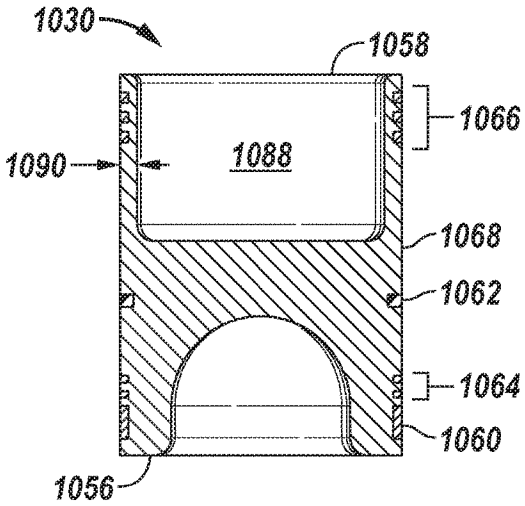
FIG. 2 is a schematic illustration of an exemplary piston according to one or more aspects of the disclosure.

Piston 1030, referred to also as a hybrid piston, is adapted to operate in a pyrotechnic environment and in a hydraulic environment. A non-limiting example of piston 1030 is described with reference to FIGS. 1 and 2. Piston 1030, depicted in FIGS. 1 and 2, includes a pyrotechnic end, or end section, 1056 and a hydraulic end, or end section 1058. Pyrotechnic end 1056 faces pyrotechnic charge 1028 and hydraulic end 1058 faces discharge end 1018. Piston 1030 may be constructed of a unitary body or may be constructed in sections (see, e.g., FIGS. 3-5) of the same or a different material. In this embodiment, piston 1030 comprises a ballistic seal (i.e., obturator seal) 1060, a hydraulic seal 1062, and a first and a second piston ring set 1064, 1066. According to an embodiment, ballistic seal 1060 is located on outer surface 1068 of pyrotechnic end 1056 of piston 1030. Ballistic seal 1060 may provide centralizing support for piston 1030 in bore 1032 and provide a gas seal to limit gas blow-by (e.g., depressurization). First piston ring set 1064 is located adjacent to ballistic seal 1060 and is separated from the terminal end of pyrotechnic end 1056 by ballistic seal 1060. Second piston ring set 1066 is located proximate the terminal end of hydraulic end section 1058.

The hydraulic seal 1062 is located between the first piston ring set 1064 and the second piston ring set 1066 in this non-limiting example of piston 1030.

According to some embodiments, one or more pressure control devices 1042 are positioned in gas chamber 1017 for example to dampen the pressure pulse and/or to control the pressure (i.e., operating or working pressure) at which fluid 1036 is exhausted from discharge port 1038. In the embodiment depicted in FIG. 1, gas chamber 1017 of pyrotechnic section 1016 includes two pressure control devices 1042, 1043 dividing gas chamber 1017 into three chambers 1044, 1046 and 1045. First chamber 1044, referred to also as breech chamber 1044, is located between first end 1014 (e.g., the connected gas generator 1026) and first pressure control device 1042 and a snubbing chamber 1046 is formed between pressure control devices 1042, 1043. Additional snubbing chambers can be provided when desired.

First pressure control device 1042 comprises an orifice 1048 formed through a barrier 1050 (e.g., orifice plate). Barrier 1050 may be constructed of a unitary portion of the body of pyrotechnic section 1016 or it may be a separate member connected with the pyrotechnic section. Second pressure control device 1043 comprises an orifice 1047 formed through a barrier 1049. Barrier 1049 may be a continuous or unitary portion of the body of pyrotechnic section 1016 or may be a separate member connected within the pyrotechnic section. The size of orifices 1048, 1047 can be sized to provide the desired working pressure of the discharged hydraulic fluid 1036.

Figure 3:
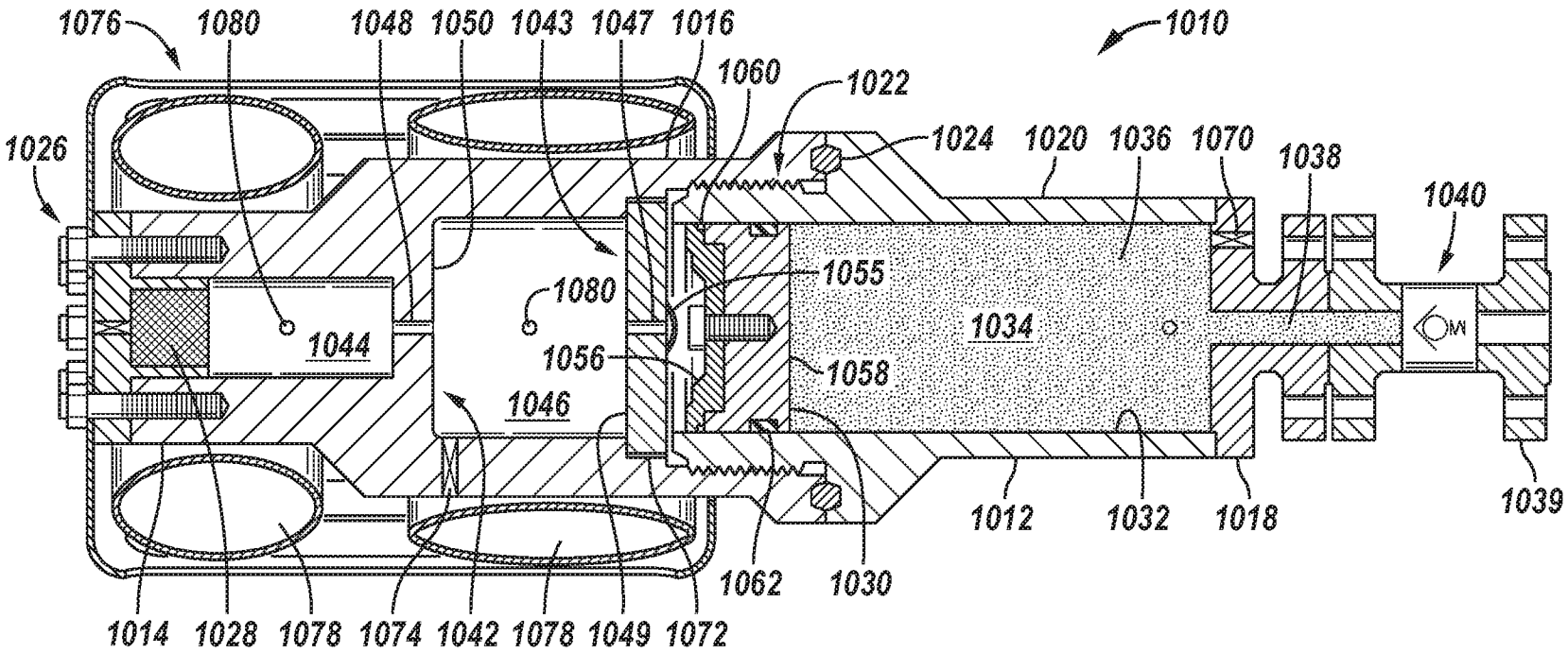
FIG. 3 is a schematic illustration of an exemplary gas generator driven hydraulic accumulator depicted in a first position prior to being activated.
Figure 4:
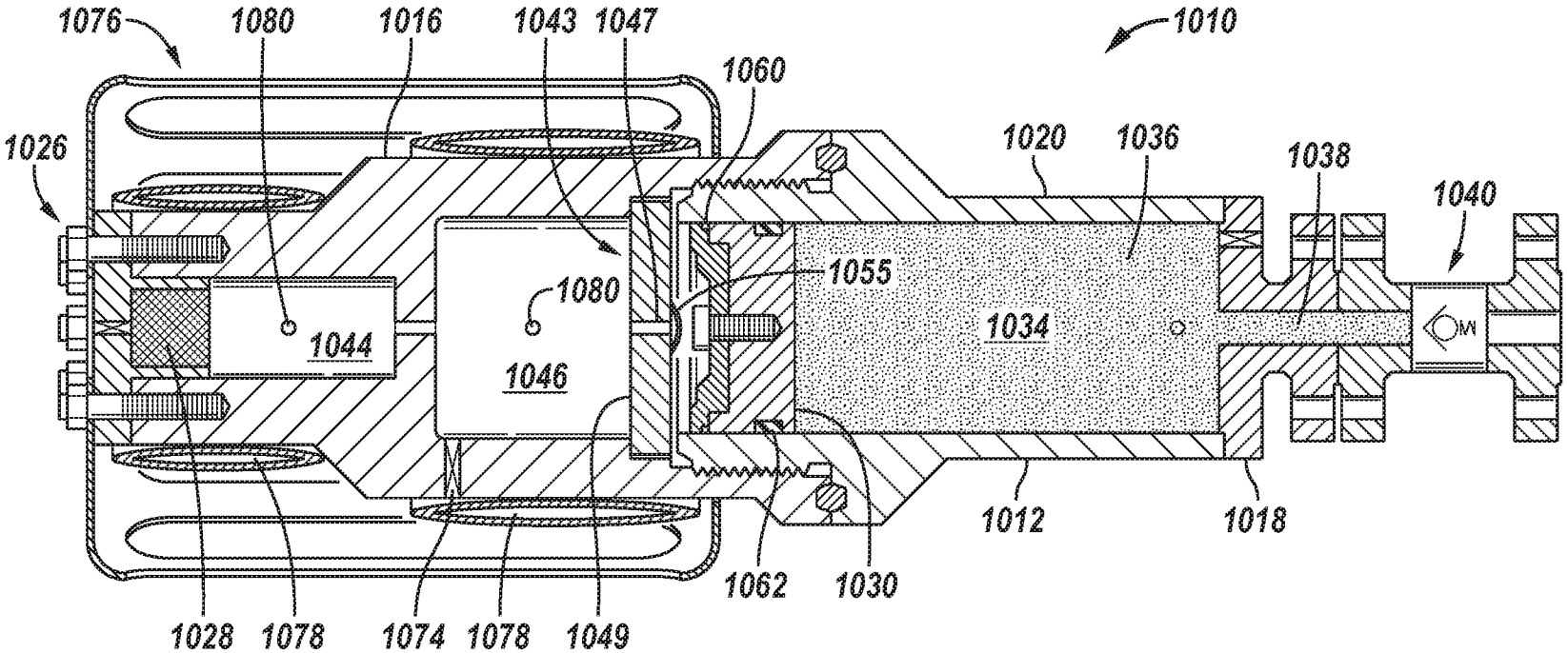
FIG. 4 is a schematic illustration of an exemplary gas generator driven hydraulic accumulator prior to being activated and depicted in a second position having higher external environmental pressure than the first position of FIG. 3.
Figure 5:
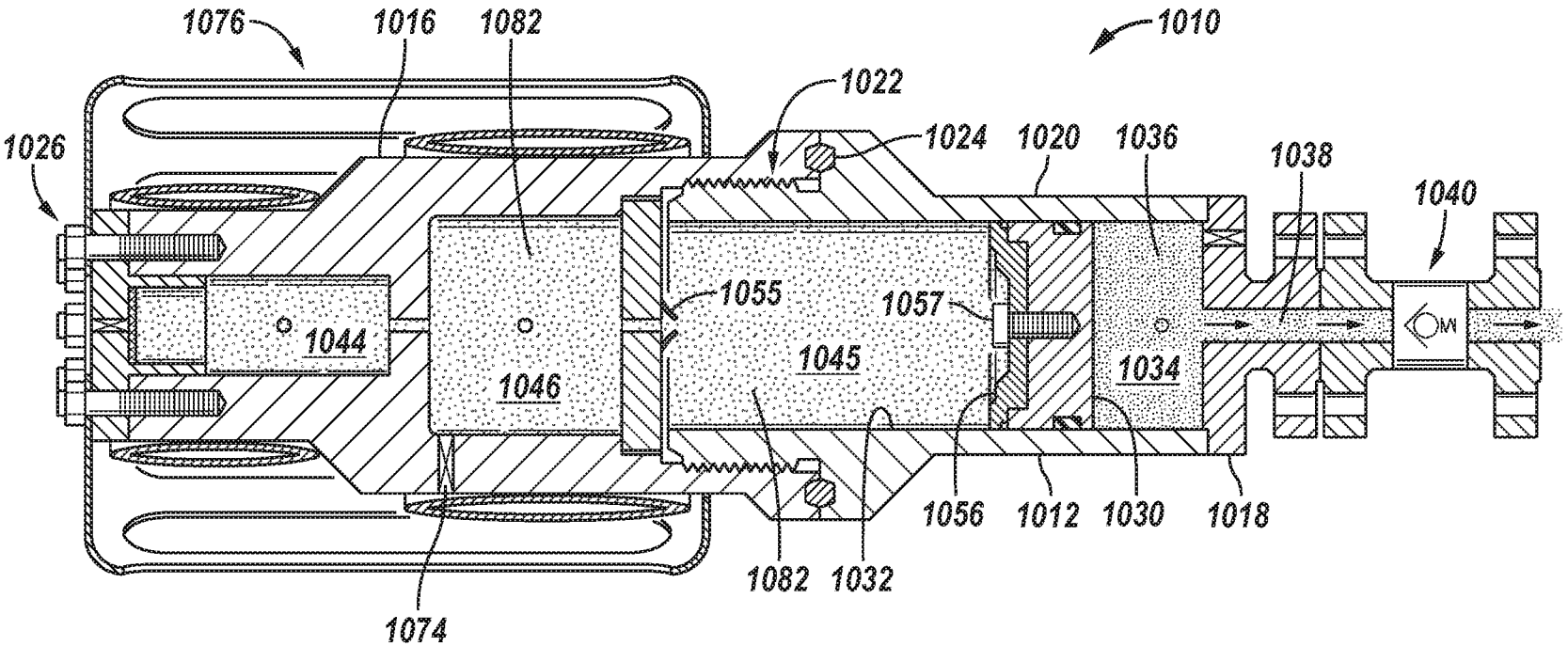
FIG. 5 is a schematic illustration of an exemplary gas generator driven hydraulic accumulator after being activated according to one or more aspects of the disclosure.

For example, in FIG. 1 pyrotechnic section 1016 includes two interconnected tubular sections or subs. In this embodiment, the first tubular sub 1052 (e.g., breech sub), includes first end 1014 and breech chamber 1044. The second tubular sub 1054, also referred to as snubbing sub 1054, forms snubbing chamber 1046 between the first pressure control device 1042, i.e., breech orifice, and the second pressure control device 1043, i.e., snubbing orifice. For example, piston 1030 and snubbing pressure control device 1043 may be inserted at the threaded joint 1022 between hydraulic section 1020 and snubbing sub 1054 as depicted in FIG. 1, formed by a portion of body 1012, and or secured for example by soldering or welding as depicted in FIGS. 3-5 (e.g., connector 1072, FIG. 3). The breech pressure control device 1042 can be inserted at the threaded joint 1022 between breech sub 1052 and snubbing sub 1054. In the FIG. 1 embodiment, barrier 1050 and/or barrier 1049 may be retained between the threaded connection 1022 of adjacent tubular sections of body 1012 and/or secured for example by welding or soldering (e.g., connector 1072 depicted in FIG. 3).

In the embodiment of FIG. 1, a rupture device 1055 closes an orifice 1048, 1047 of at least one of pressure control devices 1042, 1043. In the depicted example, rupture device 1055 closes orifice 1047 of second pressure control device 1043, adjacent to hydraulic section 1020, until a predetermined pressure differential across rupture device 1055 is achieved by the ignition of pyrotechnic charge 1028. Rupture device 1055 provides a seal across orifice 1047 prior to connecting pyrotechnic section 1016 with hydraulic section 1020 and during gas generator driven hydraulic accumulator 1010 inactivity, for example, to prevent fluid 1036 leakage to seep into pyrotechnic section 1016.

According to some embodiments, a pressure compensation device (see, e.g., FIGS. 3-5) may be connected for example with gas chamber 1017 of pyrotechnic section 1016. When being located subsea, the pressure compensation device substantially equalizes the pressure in gas chamber 1017 with the environmental hydrostatic pressure.

According to one or more embodiments, gas generator driven hydraulic accumulator 1010 may provide a hydraulic cushion to mitigate the impact of piston 1030 at discharge end 1018, for example against cap 1037. In the example depicted in FIG. 1, the cross-sectional area of discharge port 1038 decreases from an inlet end 1051 to the outlet end 1053. The tapered discharge port 1038 may act to reduce the flow rate of fluid 1036 through discharge port 1038 as piston 1030 approaches discharge end 1018 and providing a fluid buffer that reduces the impact force of piston 1030 against cap 1037.

A hydraulic cushion at the end of the stroke of piston 1030 may be provided for example, by a mating arrangement of piston 1030 and discharge end 1018 (e.g., cap 1037). For example, as illustrated in FIG. 1 and with additional reference to FIG. 2, end cap 1037 includes a sleeve section 1084 disposed inside of bore 1032 of hydraulic section 1020. Sleeve section 1084 has a smaller outside diameter than the inside diameter of bore 1032 providing an annular gap 1086. Piston 1030 has a cooperative hydraulic end 1058 that forms a cavity 1088 having an annular sidewall 1090 (e.g., skirt). Annular sidewall 1090 is sized to fit in annular gap 1086 at inlet end 1051 and sleeve 1084 fits in cavity 1088. Hydraulic fluid 1036 disposed in gap 1086 will cushion the impact of piston 1030 against end cap 1037. It is to be noted that discharge port 1038 does not have to be tapered to provide a hydraulic cushion.

In some embodiments (e.g., see FIGS. 3-5), hydraulic chamber 1034 may be filled with a volume of fluid 1036 in excess of the volume required for the particular installation of accumulator 1010. The excess volume of fluid 1036 can provide a cushion, separating piston 1030 from discharge end 1018 at the end of the stroke of piston 1030.

FIG. 3 is a sectional view of a gas generator driven hydraulic accumulator 1010 according to one or more embodiments illustrated in a first position for example prior to being deployed at a depth subsea. Gas generator driven hydraulic accumulator 1010 comprises an elongated body 1012 extending from a first end 1014 of a pyrotechnic section 1016 to discharge end 1018 of a hydraulic section 1020. In the depicted example pyrotechnic section 1016 and hydraulic section 1020 are connected at a threaded joint 1022 having at least one seal 1024.

Hydraulic section 1020 comprises a bore 1032 in which a piston 1030 (i.e., hybrid piston) is movably disposed. Piston 1030 comprises a pyrotechnic end section 1056 having a ballistic seal 1060 and hydraulic end section 1058 having a hydraulic seal 1062. In the depicted embodiment, piston 1030 is a two-piece construction. Pyrotechnic end section 1056 and hydraulic end section 1058 are depicted coupled by a connector, generally denoted by the numeral 1057 in FIG. 5. Connector 1057 is depicted as a bolt, e.g., threaded bolt, although other attaching devices and mechanism (e.g., adhesives may be utilized). Hydraulic chamber 1034 is formed between piston 1030 and discharge end 1018. A flow control device 1040 is disposed with discharge port 1038 of discharge end 1018 substantially restricting fluid flow to one-direction from hydraulic chamber 1034 through discharge port 1038.

Hydraulic chamber 1034 may be filled with hydraulic fluid 1036 for example through discharge port 1038. Port 1070 (e.g., valve) is utilized to relieve pressure from hydraulic chamber 1034 during fill operations or to drain fluid 1036 for example if an un-actuated gas generator driven hydraulic accumulator 1010 is removed from a system.

In the depicted embodiment, pyrotechnic section 1016 includes a breech chamber 1044 and a snubbing chamber 1046. Gas generator 1026 is illustrated connected, for example by a bolted interface, to first end 1014 disposing pyrotechnic charge 1028 into breech chamber 1044. Breech chamber 1044 and snubbing chamber 1046 are separated by pressure control device 1042, which is illustrated as an orifice 1048 formed through breech barrier 1050. In this non-limiting example, breech barrier 1050 is formed by a portion of body 1012 forming pyrotechnic section 1016. Breech orifice 1048 can be sized for the desired operating pressure of gas generator driven hydraulic accumulator 1010.

Snubbing chamber 1046 is formed in pyrotechnic section 1016 between barrier 1050 and a snubbing barrier 1049 of second pressure control device 1043. Pressure control device 1043 has a snubbing orifice 1047 formed through snubbing barrier 1049. In the illustrated embodiment, snubbing barrier 1049 may be secured in place by a connector 1072. In this example, connector 1072 is a solder or weld to secure barrier 1049 (i.e., plate) in place and provide additional sealing along the periphery of barrier 1049. Snubbing orifice 1047 may be sized for the fluid capacity and operating pressure of the particular gas generator driven hydraulic accumulator 1010 for example to dampen the pyrotechnic charge pressure pulse. A rupture device 1055 is depicted disposed with the orifice 1047 to seal the orifice and therefore gas chambers 1044, 1046 during inactivity of the deployed gas generator driven hydraulic accumulator 1010. Rupture device 1055 can provide a clear opening during activation of gas generator driven hydraulic accumulator 1010 and burning of charge 1028.

A vent 1074, i.e., valve, is illustrated in communication with gas chamber 1017 to relieve pressure from the gas chambers prior to disassembly after gas generator driven hydraulic accumulator 1010 has been operated.

FIGS. 3 to 5 illustrate a pressure compensation device 1076 in operational connection with the gas chambers, breech chamber 1044 and snubbing chamber 1046, to increase the pressure in the gas chambers in response to deploying gas generator driven hydraulic accumulator 1010 subsea. In the depicted embodiment, pressure compensator 1076 includes one or more devices 1078 (e.g. bladders) containing a gas (e.g., nitrogen). Bladders 1078 are in fluid connection with gas chambers 1017 (e.g., chambers 1044, 1046, etc.) for example through ports 1080.

Refer now to FIG. 4, wherein gas generator driven hydraulic accumulator 1010 is depicted deployed subsea (see, e.g., FIGS. 6-8) prior to being activated. In response to the hydrostatic pressure at the subsea depth of gas generator driven hydraulic accumulator, bladders 1078 have deflated, thereby pressurizing breech chamber 1044 and snubbing chamber 1046.

FIG. 5 illustrates an embodiment of gas generator driven hydraulic accumulator 1010 after being activated. With reference to FIGS. 4 and 5, gas generator driven hydraulic accumulator 1010 is activated by igniting pyrotechnic charge 1028. The ignition generates gas 1082, which expands in breech chamber 1044 and snubbing chamber 1046. The pressure in the gas chambers ruptures rupture device 1055 and the expanding gas acts on pyrotechnic side 1056 of piston 1030. Piston 1030 is moved toward discharge end 1018 in response to the pressure of gas 1082 thereby discharging pressurized fluid 1036 through discharge port 1038 and flow control device 1040. In FIG. 5, piston 1030 is illustrated spaced a distance apart from discharge end 1018. In accordance to one or more embodiments, at least a portion of the volume of fluid 1036 remaining in hydraulic fluid chamber 1034 is excess volume supplied to provide a space (i.e., cushion) between piston 1030 and discharge end 1018 at the end of the stroke of piston 1030.

Gas generator driven hydraulic accumulator 1010 can be utilized in many applications wherein an immediate and reliable source of pressurized fluid is required. Gas generator driven hydraulic accumulator 1010 provides a sealed system that is resistant to corrosion and that can be constructed of a material for installation in hostile environments. Additionally, gas generator driven hydraulic accumulator 1010 can provide a desired operating pressure level without regard to the ambient environmental pressure.

A method of operation and is now described with reference to FIGS. 6-9 which illustrate a subsea well system in which one or more gas generator driven hydraulic accumulators are utilized. An example of a subsea well system is described in U.S. patent application publication No. 2012/0048566, which is incorporated by reference herein.

Figure 6:
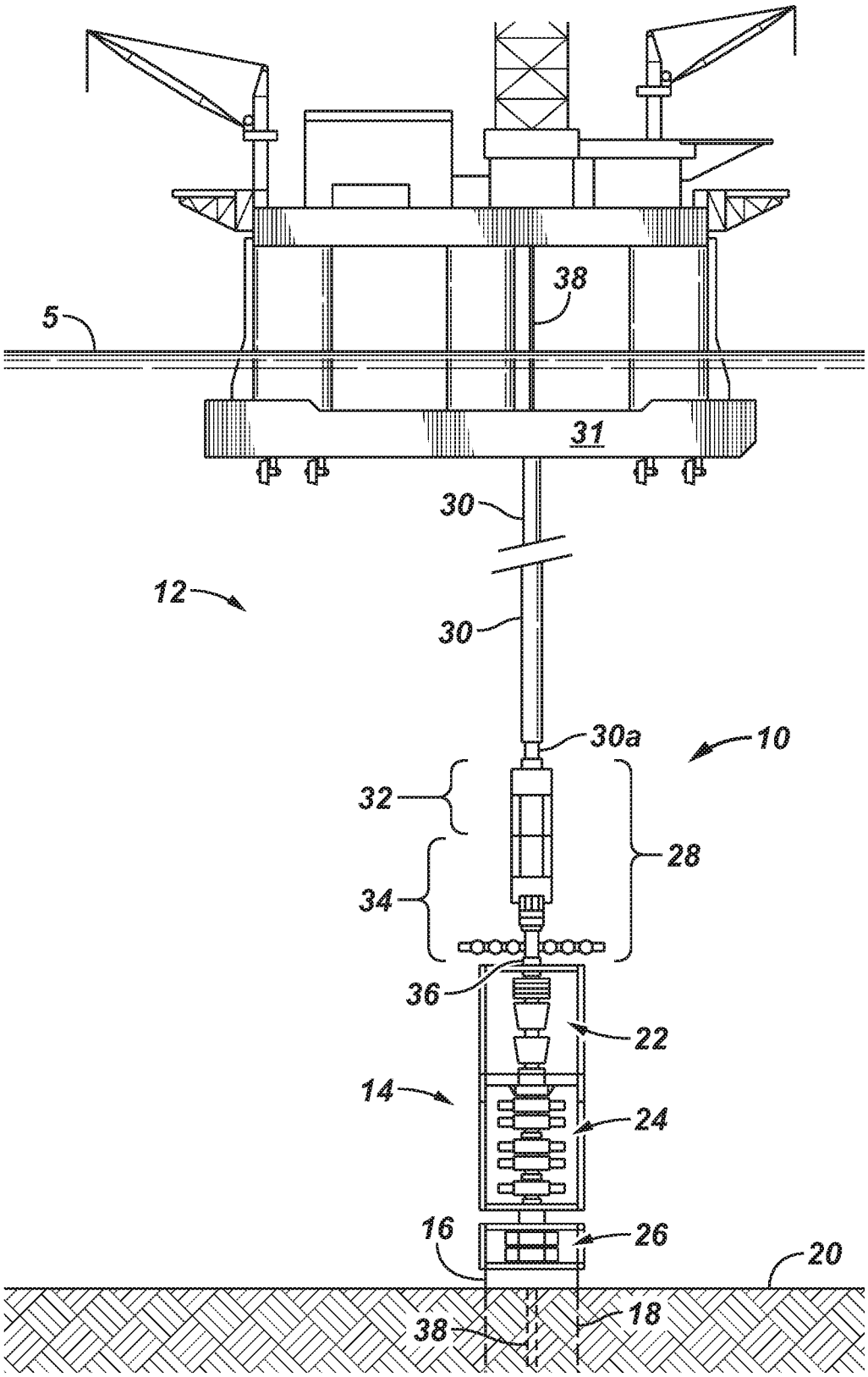
FIGS. 6 and 7 illustrate an exemplary subsea well system in which a gas generator driven hydraulic accumulator according to one or more aspects of the disclosure can be utilized.

FIG. 6 is a schematic illustration of a subsea well safing system, generally denoted by the numeral 10, being utilized in a subsea well drilling system 12. In the depicted embodiment drilling system 12 includes a BOP stack 14 which is landed on a subsea wellhead 16 of a well 18 (i.e., wellbore) penetrating seafloor 20. BOP stack 14 conventionally includes a lower marine riser package ("LMRP") 22 and blowout preventers ("BOP") 24. The depicted BOP stack 14 also includes subsea test valves ("SSTV") 26. As will be understood by those skilled in the art with the benefit of this disclosure, BOP stack 14 is not limited to the devices depicted.

Figure 7:
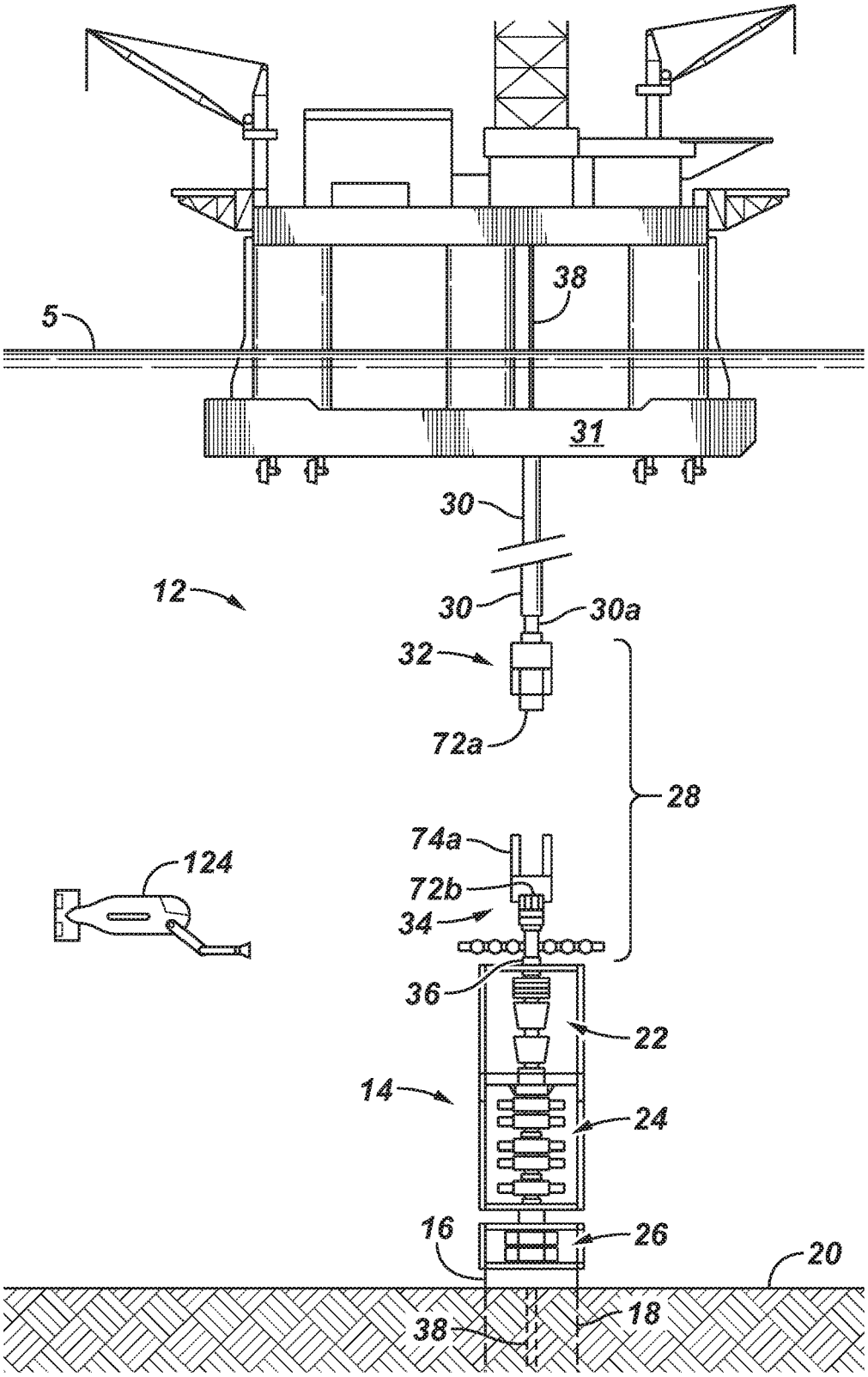

Subsea well safing system 10 comprises safing package, or assembly, referred to herein as a catastrophic safing package ("CSP") 28 that is landed on BOP stack 14 and operationally connects a riser 30 extending from platform 31 (e.g., vessel, rig, ship, etc.) to BOP stack 14 and thus well 18. CSP 28 comprises an upper CSP 32 and a lower CSP 34 that are adapted to separate from one another in response to initiation of a safing sequence thereby disconnecting riser 30 from the BOP stack 14 and well 18, for example as illustrated in FIG. 7. The safing sequence is initiated in response to parameters indicating the occurrence of a failure in well 18 with the potential of leading to a blowout of the well. Subsea well safing system 10 may automatically initiate the safing sequence in response to the correspondence of monitored parameters to selected safing triggers. According to one or more embodiments, CSP 28 includes one or more gas generator driven hydraulic accumulators 1010 (see, e.g., FIGS. 8 and 9) to provide hydraulic pressure on-demand to operate one or more of the well system devices (e.g., valves, connectors, ejector bollards, rams, and shears).

Wellhead 16 is a termination of the wellbore at the seafloor and generally has the necessary components (e.g., connectors, locks, etc.) to connect components such as BOPs 24, valves (e.g., test valves, production trees, etc.) to the wellbore. The wellhead also incorporates the necessary components for hanging casing, production tubing, and subsurface flow-control and production devices in the wellbore.

LMRP 22 and BOP stack 14 are coupled by a connector that is engaged with a corresponding mandrel on the upper end of BOP stack 14. LMRP 22 typically provides the interface (i.e., connection) of the BOPs 24 and the bottom end 30*a* of marine riser 30 via a riser connector 36 (i.e., riser adapter). Riser connector 36 may further comprise one or more ports for connecting fluid (i.e., hydraulic) and electrical conductors, i.e., communication umbilical, which may extend along (exterior or interior) riser 30 from the drilling platform located at surface 5 to subsea drilling system 12. For example, it is common for a well control choke line 44 and a kill line 46 to extend from the surface for connection to BOP stack 14.

Riser 30 is a tubular string that extends from the drilling platform 31 down to well 18. The riser is in effect an extension of the wellbore extending through the water column to drilling platform 31. The riser diameter is large enough to allow for drillpipe, casing strings, logging tools and the like to pass through. For example, in FIGS. 6 and 7, a tubular 38 (e.g., drillpipe) is illustrated deployed from drilling platform 31 into riser 30. Drilling mud and drill cuttings can be returned to surface 5 through riser 30. Communication umbilical (e.g., hydraulic, electric, optic, etc.) can be deployed exterior to or through riser 30 to CSP 28 and BOP stack 14. A remote operated vehicle ("ROV") 124 is depicted in FIG. 7 and may be utilized for various tasks including installing and removing gas generator driven hydraulic accumulators 1010.

Figure 8:
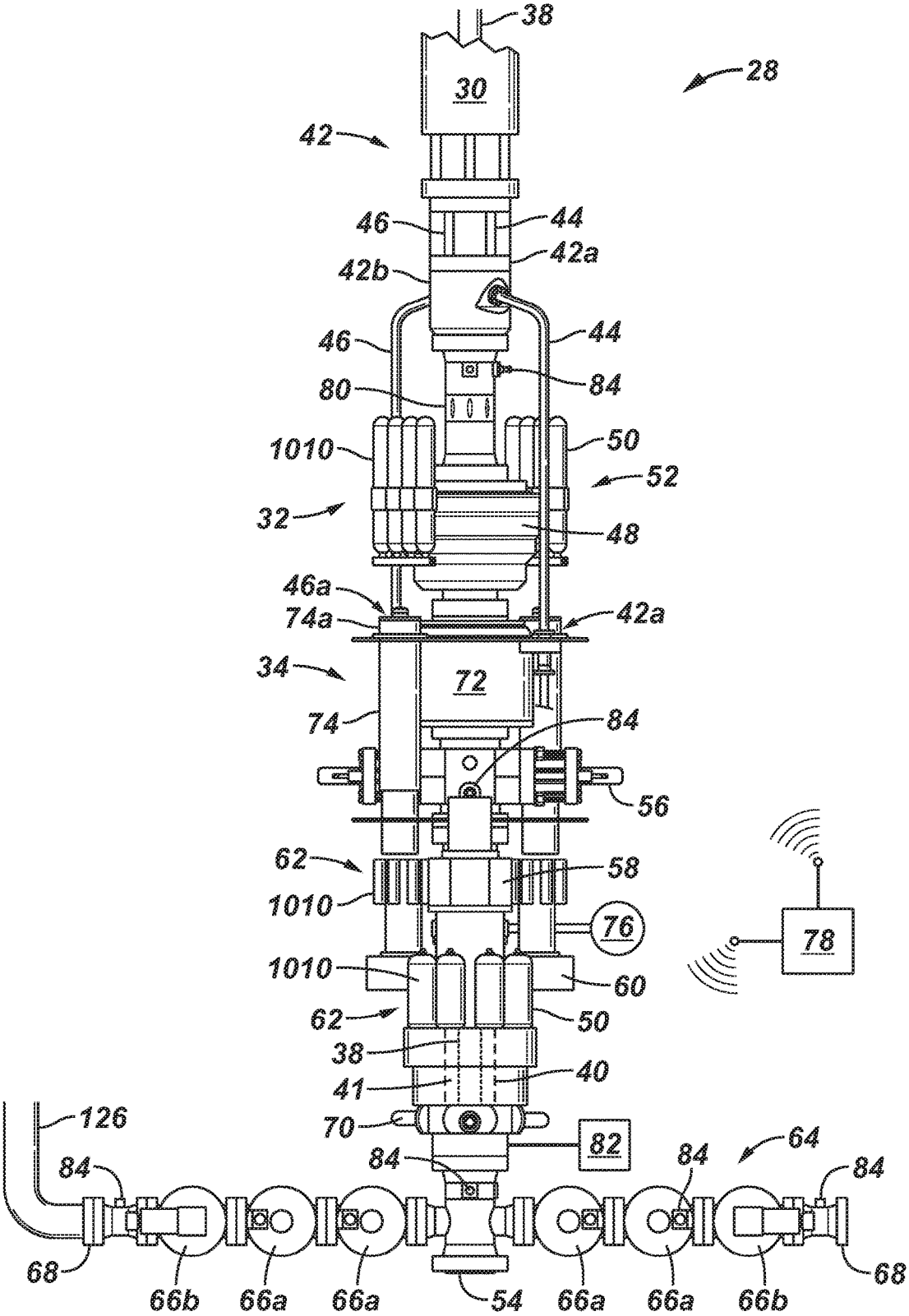
FIG. 8 illustrates an exemplary subsea well safety system utilizing a gas generator driven hydraulic accumulator according to one or more aspects of the disclosure.

Refer now to FIG. 8 illustrating a subsea well safing package 28 according to one or more embodiments in isolation. CSP 28 depicted in FIG. 8 is further described with reference to FIGS. 6 and 7. In the depicted embodiment, CSP 28 comprises upper CSP 32 and lower CSP 34. Upper CSP 32 comprises a riser connector 42, which may include a riser flange connection 42*a*, and a riser adapter 42*b* which may provide for connection of a communication umbilical and extension of the communication umbilical to various CSP 28 devices and/or BOP stack 14 devices. For example, a choke line 44 and a kill line 46 are depicted extending from the surface with riser 30 and extending through riser adapter 42*b* for connection to the choke and kill lines of BOP stack 14. CSP 28 comprises a choke stab 44*a* and a kill line stab 46*a* for interconnecting the upper and lower portions of choke line 44 and kill line 46. Stabs 44*a*, 46*a* provide for disconnecting the choke and kill lines during safing operations and for reconnecting during subsequent recovery and reentry operations. CSP 28 comprises an internal longitudinal bore 40, depicted in FIG. 8 by the dashed line through lower CSP 34, for passing tubular 38. Annulus 41 is formed between the outside diameter of tubular 38 and the diameter of bore 40.

Upper CSP 32 further comprises slips 48 adapted to close on tubular 38. Slips 48 are actuated in the depicted embodiment by hydraulic pressure from a pre-charged hydraulic accumulator 50 and/or a gas generator driven hydraulic accumulator 1010. In the depicted embodiment, CSP 28 includes a plurality of pre-charged hydraulic accumulators 50 and gas generator driven hydraulic accumulators 1010, which may be interconnected in pods, such as upper hydraulic accumulator pod 52. A gas generator driven hydraulic accumulator 1010 located in the upper hydraulic accumulator pod 52 is hydraulically connected to one or more devices, such as slips 48. The accumulators 1010, 50 can be monitored and the pressure accumulators can be actuated in sequence as may be needed to ensure that the adequate hydraulic pressure and volume is supplied to actuate an operational device, such as slips 48.

Lower CSP 34 comprises a connector 54 to connect to BOP stack 14, for example, via riser connector 36, rams 56 (e.g., blind rams), high energy shears 58, lower slips 60 (e.g., bi-directional slips), and a vent system 64 (e.g., valve manifold). Vent system 64 comprises one or more valves 66. In this embodiment, vent system 64 comprises vent valves (e.g., ball valves) 66*a*, choke valves 66*b*, and one or more connection mandrels 68. Valves 66*b* can be utilized to control fluid flow through connection mandrels 68. For example, a recovery riser 126 is depicted connected to one of mandrels 68 for flowing effluent from the well and/or circulating a kill fluid (e.g., drilling mud) into the well. In the embodiment of FIG. 8, a chemical source 76, e.g., methanol is illustrated for injection into the system for example to prevent hydrate formation.

In the depicted embodiment, lower CSP 34 further comprises a deflector device 70 (e.g., impingement device, shutter ram) disposed above vent system 64 and below lower slips 60, shears 58, and blind rams 56. Lower CSP 34 includes a plurality of hydraulic accumulators 50 and gas generator driven hydraulic accumulators 1010 arranged and connected in one or more lower hydraulic pods 62 for operations of the various hydraulically operated devices of CSP 28 and the well system. The accumulators can be monitored and the gas generator driven hydraulic accumulators can be actuated in sequence as may be needed to ensure that the necessary volume of hydraulic fluid and the necessary operating pressure is supplied to actuate the operational device.

Upper CSP 32 and lower CSP 34 are detachably connected to one another by a connector 72. In FIG. 7, the illustrated connector 72 includes a first connector portion 72*a* disposed with the upper CSP 32 and a second connector portion 72*b* disposed with the lower CSP 34. An ejector device 74 (e.g., ejector bollards) is operationally connected between upper CSP 32 and lower CSP 34 to separate upper CSP 32 and riser 30 from lower CSP 34 and BOP stack 14 after connector 72 has been actuated to the unlocked position. Ejector device 74 can be actuated by operation of gas generator driven hydraulic accumulator 1010.

CSP 28 includes a plurality of sensors 84 that can sense various parameters, such as and without limitation, temperature, pressure, strain (tensile, compression, torque), vibration, and fluid flow rate. Sensors 84 further includes, without limitation, erosion sensors, position sensors, and accelerometers and the like. Sensors 84 can be in communication with one or more control and monitoring systems, for example forming a limit state sensor package.

According to one or more embodiments, CSP 28 comprises a control system 78 that may be located subsea, for example at CSP 28 or at a remote location such as at the surface. Control system 78 may comprise one or more controllers located at different locations. For example, in at least one embodiment, control system 78 comprises an upper controller 80 (e.g., upper command and control data bus) and a lower controller 82 (e.g., lower command and controller bus). Control system 78 may be connected via conductors (e.g., wire, cable, optic fibers, hydraulic lines) and/or wirelessly (e.g., acoustic transmission) to various subsea devices (e.g., gas generator driven hydraulic accumulators 1010) and to surface (i.e., drilling platform 31) control systems.

The depicted control system 78 includes upper controller 80 and lower controller 82. Each of upper and lower controllers 80, 82 may have a collection of real-time computer circuitry, field programmable gate arrays (FPGA), I/O modules, power circuitry, power storage circuitry, software, and communications circuitry. One or both of upper and lower controller 80, 82 may include control valves.

One of the controllers, for example lower controller 82, may serve as the primary controller and provide command and control sequencing to various subsystems of safing package 28 and/or communicate commands from a regulatory authority for example located at the surface. The primary controller, e.g., lower controller 82, contains communications functions, and health and status parameters (e.g., riser strain, riser pressure, riser temperature, wellhead pressure, wellhead temperature, etc.). One or more of the controllers may have black-box capability (e.g., a continuous-write storage device that does not require power for data recovery).

Upper controller 80 is described herein as operationally connected with a plurality of sensors 84 positioned throughout CSP 28 and may include sensors connected to other portions of the drilling system, including along riser 30, at wellhead 16, and in well 18. Upper controller 80, using data communicated from sensors 84, continuously monitors limit state conditions of drilling system 12. According to one or more embodiments, upper controller 80, may be programmed and reprogrammed to adapt to the personality of the well system based on data sensed during operations. If a defined limit state is exceeded an activation signal (e.g., alarm) can be transmitted to the surface and/or lower controller 82. A safing sequence may be initiated automatically by control system 78 and/or manually in response to the activation signal.

Figure 9:
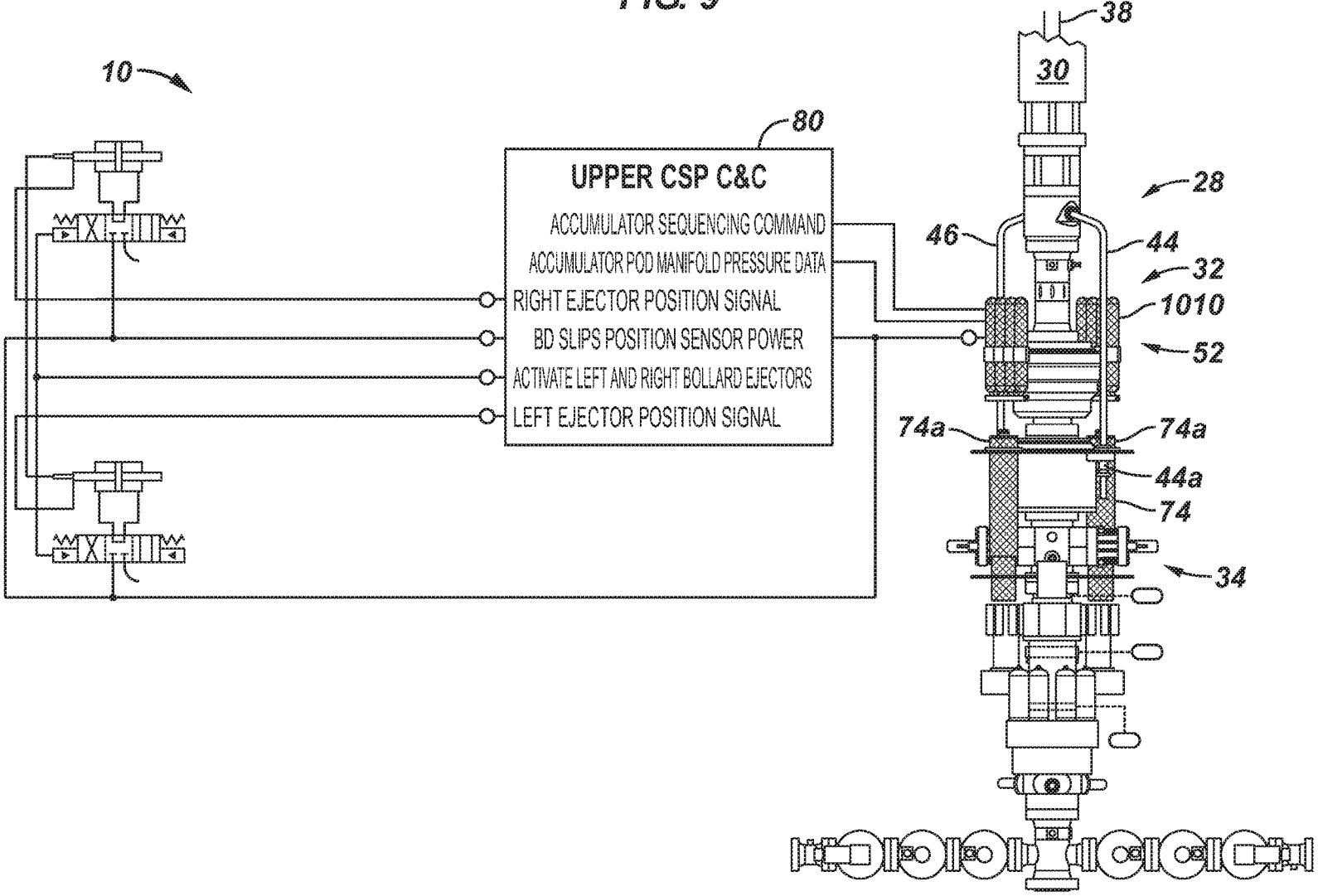
FIG. 9 is a schematic diagram illustrating operation of a gas generator driven hydraulic accumulator in accordance with one or more aspects of the disclosure.

FIG. 9 is a schematic diagram of sequence step, according to one or more embodiments of subsea well safing system 10 illustrating operation of ejector devices 74 (i.e., ejector bollards) to physically separate upper CSP 32 and riser 30 from lower CSP 34 as depicted in FIG. 7. For example, ejector devices 74 may include piston rods 74*a* that extend to push the upper CSP 32 away from lower CSP 34 in the depicted embodiment. FIG. 7 illustrates piston rod 74*a* in an extended position. In the embodiment of FIG. 9, actuation of ejector devices 74 is provided by upper controller 80 sending a signal activating a gas generator driven hydraulic accumulator 1010 located for example in upper accumulator pod 52 to direct the hydraulic fluid at operating pressure to ejector devices 74. The additional gas generator driven pressure accumulators 1010 can be activated to supply additional hydraulic fluid to actuate the operational device, e.g. the ejector device. The control system may monitor the status (e.g., position, pressure) of the various operation device and the accumulators may be activated in sequence as may be needed to ensure that the adequate hydraulic volume is supplied to actuate the operational device.

Referring also to FIGS. 1-5, an electronic signal is transmitted from controller 80 and received at gas generator 1026. The firing signal may be an electrical pulse and/or coded signal. In response to receipt of the firing signal, igniter 1029 ignites pyrotechnic charge 1028 thereby generating gas 1082 (FIG. 5) that drives piston 1030 toward discharge end 1018 thereby pressurizing fluid 1036 and discharging the pressurized fluid 1036 through discharge port 1038 to ejector device 74. Similarly, gas generator driven hydraulic accumulators 1010 can be activated to supply on-demand hydraulic pressure to other devices such as, and without limitation to, valves, slips, rams, shears, and locks.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A gas generator driven hydraulic accumulator for supplying hydraulic pressure to a device that is associated with a well system and/or a device that is located subsea, comprising:

an elongated body having a first end, a second end, and a bore extending axially from a barrier to the second end;

a piston slidably disposed in the bore;

in use a gas generator located in a chamber between the first end and the barrier;

an orifice through the barrier providing fluid communication between the chamber and the bore;

in use a hydraulic fluid disposed in the bore between the piston and the second end whereby the hydraulic fluid is exhausted under pressure through a discharge port in response to activation of the gas generator; and in use a one-way flow control device connected in a flow path of the discharge port to permit one-way flow of the hydraulic fluid from the bore and to block return fluid from through the discharge port into the bore.

2. The gas generator driven hydraulic accumulator of claim 1, wherein the gas generator is a propellant.

3. The gas generator driven hydraulic accumulator of claim 1, wherein a cross-sectional area of the discharge port decreases from an inlet end to an outlet end.

4. The gas generator driven hydraulic accumulator of claim 1, wherein the elongated body is tubular.

5. The gas generator driven hydraulic accumulator of claim 1, wherein the elongated body is formed by a single tubular member.

6. A subsea well system, comprising:

an operational device located subsea and connected with a wellbore penetrating a seafloor, the operational device responsive to an operating pressure; and a plurality of hydraulic accumulators located subsea, the plurality of hydraulic accumulators comprising a gas generator driven hydraulic accumulator comprising:

an elongated body having a first end, a second end, and a bore extending axially from a barrier to the second end;

a discharge port in communication with the operational device;

a piston slidably disposed in the bore;

a propellant located in a chamber between the first end and the barrier;

an orifice through the barrier providing fluid communication between the chamber and the bore; and a hydraulic fluid disposed in the bore between the piston and the second end at a pressure below the operating pressure, wherein the hydraulic fluid is exhausted through the discharge port and to the operational device at a pressure equal to or greater than the operating pressure in response to activation of the propellant.

7. The subsea well system of claim 6, wherein the plurality of hydraulic accumulators consist of gas generator driven hydraulic accumulators.

8. The subsea well system of claim 6, wherein the plurality of hydraulic accumulators comprises a pre-charged hydraulic accumulator storing hydraulic fluid at a pressure equal to or greater than the operating pressure.

9. The subsea well system of claim 6, wherein the operational device is one of a valve or a hydraulic ram.

10. The subsea well system of claim 6, wherein the operational device is a tubular shear.

11. The subsea well system of claim 6, wherein the elongated body is formed by a single tubular member.

12. The subsea well system of claim 6, wherein the elongated body is tubular.

13. The subsea well system of claim 6, wherein the gas generator driven hydraulic accumulator does not comprise depth compensation.

14. A method, comprising:

supplying hydraulic fluid from two or more gas generator driven hydraulic accumulators at a pressure equal to or greater than an operating pressure to a hydraulically operated device that is located subsea and connected with a wellbore penetrating a seafloor, wherein the gas generator driven hydraulic accumulators comprise:

an elongated body having a first end, a second end, and a bore extending axially from a barrier to the second end;

a discharge port in communication with the hydraulically operated device;

a piston slidably disposed in the bore;

a propellant located in a chamber between the first end and the barrier;

an orifice through the barrier providing fluid communication between the chamber and the bore; and a hydraulic fluid disposed in the bore between the piston and the second end at a pressure below the operating pressure;

igniting the propellant and pressurizing the hydraulic fluid in a first one of the two or more gas generator driven hydraulic accumulators to a pressure equal to or greater than the operating pressure;

discharging the pressurized hydraulic fluid from the first one of the two or more gas generator driven hydraulic accumulators to the hydraulically operated device;

igniting the propellant and pressurizing the hydraulic fluid in a second one of the two or more gas generator driven hydraulic accumulators to a pressure equal to or greater than the operating pressure; and discharging the pressurized hydraulic fluid from the second one of the two or more gas generator driven hydraulic accumulators to the hydraulically operated device.

15. The method of claim 14, wherein the gas generator driven hydraulic accumulators do not comprise depth compensation.

16. The method of claim 14, further comprising a control system in communication with the two or more gas generator driven hydraulic accumulators and in communication with a sensor monitoring the wellbore; and the control system, in response to the sensor monitoring, supplying the hydraulic fluid at the pressure equal to or greater than the operating pressure to the hydraulically operated device.

17. The method of claim 14, wherein the hydraulically operated device is one a hydraulic ram or a valve.

18. The method of claim 14, wherein the hydraulically operated device is a tubular shear.

19. The method of claim 14, further comprising blocking return flow of the pressurized hydraulic fluid in the direction into the bore through the discharge port.

20. The method of claim 19, wherein the hydraulically operated device is a tubular shear.

* * * * *